US011318367B2

(12) United States Patent
Mercer et al.

(10) Patent No.: US 11,318,367 B2
(45) Date of Patent: May 3, 2022

(54) APPARATUSES AND METHODS FOR SHUFFLER TRANSPORT AND INSTALLATION

(71) Applicant: SG Gaming, Inc., Las Vegas, NV (US)

(72) Inventors: Haven A. Mercer, Excelsior, MN (US); Christopher J. Hannigan, Minneapolis, MN (US); Jamal Kotifani, Eden Prairie, MN (US); Matthew J. Lucchetti, Las Vegas, NV (US); Paul K. Scheper, Bloomington, MN (US); Michael Vizzo, Las Vegas, NV (US)

(73) Assignee: SG Gaming, Inc., Las Vegas, NV (US)

( * ) Notice: Subject to any disclaimer, the term of this patent is extended or adjusted under 35 U.S.C. 154(b) by 0 days.

(21) Appl. No.: 16/868,516

(22) Filed: May 6, 2020

(65) Prior Publication Data

US 2020/0353345 A1 Nov. 12, 2020

Related U.S. Application Data

(60) Provisional application No. 62/845,049, filed on May 8, 2019.

(51) Int. Cl.
*A63F 1/12* (2006.01)
*A63F 1/06* (2006.01)

(52) U.S. Cl.
CPC ..... *A63F 1/12* (2013.01); *A63F 1/067* (2013.01)

(58) Field of Classification Search
CPC ..... A63F 1/12; A63F 1/067
See application file for complete search history.

(56) References Cited

U.S. PATENT DOCUMENTS 3,905,311 A * 9/1975 Carpentier ..... A47B 23/046 108/136
4,195,829 A * 4/1980 Reser ..... A61G 13/02 5/607
5,022,327 A * 6/1991 Solomon ..... A47B 23/046 108/147
6,269,753 B1 * 8/2001 Roddan ..... A47B 21/00 108/50.01
7,036,818 B2 5/2006 Grauzer et al.
7,384,044 B2 6/2008 Grauzer et al.
7,523,935 B2 4/2009 Grauzer et al.
(Continued)

OTHER PUBLICATIONS

"Battery Cart Service Manual", Shuffle Master, Copyright 1997, 21 pages.

(Continued)

*Primary Examiner* — William M Pierce

(57) ABSTRACT

A card shuffler system includes an automatic card shuffler for shuffling playing cards and a shuffler transport device coupled to the automatic card shuffler to move and support the automatic card shuffler. The shuffler transport device includes a base assembly for moving along a ground surface, a vertical support, and an adjustment assembly coupled to the vertical support. The vertical support extends from the base assembly and is coupled to the automatic card shuffler to cantilever the automatic card shuffler over the base assembly. The adjustment assembly adjusts the height of the automatic card shuffler between at least a first height and a second height along a vertical axis. The vertical adjustment of the shuffler may facilitate installation of the shuffler at an installation point.

11 Claims, 8 Drawing Sheets

(56) References Cited

U.S. PATENT DOCUMENTS 8,065,966 B1 * 11/2011 Bacon ..... A47B 9/16 108/145
8,082,857 B2 * 12/2011 George ..... G16H 15/00 108/50.01
8,100,061 B2 * 1/2012 Hookway ..... A47B 23/046 108/50.01
8,316,777 B1 * 11/2012 Rosing ..... A47B 23/046 108/49
9,993,076 B2 * 6/2018 Harrington ..... B60B 33/00
2003/0112147 A1 * 6/2003 George ..... A61B 5/742 340/691.6
2004/0163574 A1 * 8/2004 Schoenbach ..... A47B 23/046 108/50.01
2005/0132935 A1 * 6/2005 Lahmann ..... A47B 23/00 108/49
2009/0212670 A1 * 8/2009 Bustle ..... A47B 21/0314 312/209
2009/0307843 A1 * 12/2009 Hookway ..... A47B 23/046 5/425
2011/0006480 A1 * 1/2011 Grauzer ..... A63F 1/14 273/149 R
2012/0119040 A1 * 5/2012 Ergun ..... A47B 21/02 248/126
2013/0026310 A1 * 1/2013 Belcourt-McCabe ..... G03B 21/54 248/125.1
2013/0087972 A1 * 4/2013 Snow ..... A63F 1/14 273/149 R
2013/0307237 A1 * 11/2013 Chen ..... A61G 12/001 280/35
2017/0173448 A1 * 6/2017 Martino ..... F21V 33/008
2020/0154879 A1 * 5/2020 Pei ..... B66F 3/28

OTHER PUBLICATIONS

"MD2 CR Workstation with Card Recognition Service Manual", Shuffle Master, May 27, 2016, 65 pages.
MD2 CR Workstation Cart, Shuffle Master, 1 page.
"Sure-Shuffler", Casino Concepts, 1997, 1 page.

* cited by examiner

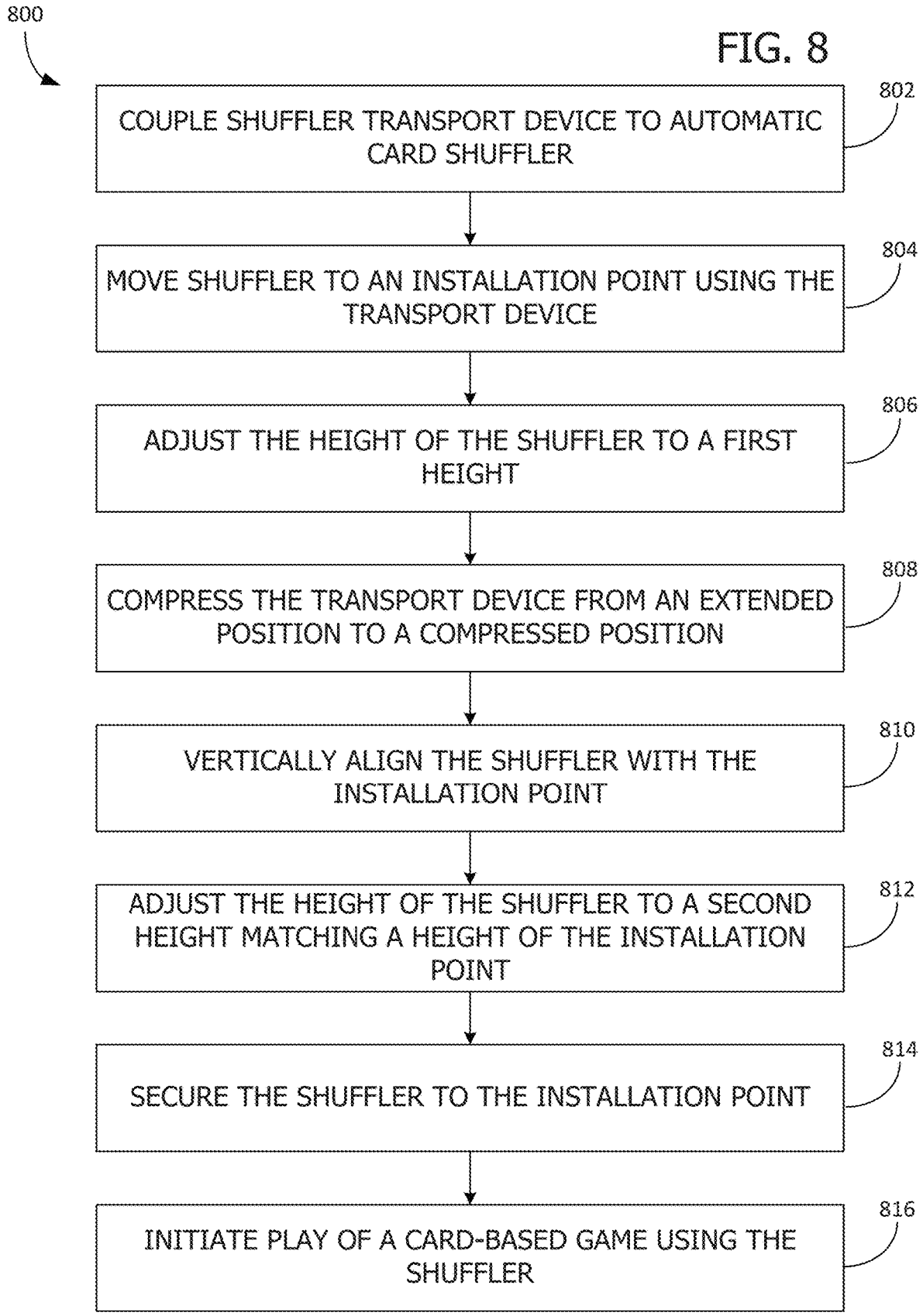
800
FIG. 8
COUPLE SHUFFLER TRANSPORT DEVICE TO AUTOMATIC CARD SHUFFLER
802
MOVE SHUFFLER TO AN INSTALLATION POINT USING THE TRANSPORT DEVICE
804
ADJUST THE HEIGHT OF THE SHUFFLER TO A FIRST HEIGHT
806
COMPRESS THE TRANSPORT DEVICE FROM AN EXTENDED POSITION TO A COMPRESSED POSITION
808
VERTICALLY ALIGN THE SHUFFLER WITH THE INSTALLATION POINT
810
ADJUST THE HEIGHT OF THE SHUFFLER TO A SECOND HEIGHT MATCHING A HEIGHT OF THE INSTALLATION POINT
812
SECURE THE SHUFFLER TO THE INSTALLATION POINT
814
INITIATE PLAY OF A CARD-BASED GAME USING THE SHUFFLER
816

APPARATUSES AND METHODS FOR SHUFFLER TRANSPORT AND INSTALLATION

CROSS-REFERENCE TO RELATED APPLICATIONS

This application claims the benefit of priority of U.S. Provisional Patent Application Ser. No. 62/845,049, filed May 8, 2019, the contents of which are hereby incorporated by reference in their entirety.

TECHNICAL FIELD

The disclosure relates to transport and support of card handling devices and related assemblies, components, and methods. In particular, embodiments of the disclosure relate to transport and support devices for card handling devices, card handling devices with transport and support components, and methods for transporting card handling devices.

BACKGROUND

Wagering games are often based on the outcome of randomly generated arrangements of cards. Such games are widely played in gaming establishments and, often, a single deck or multiple decks of fifty-two (52) playing cards may be used to play the game. Gaming using multiple decks of playing cards may include, for example, six to ten decks used in games such as blackjack and baccarat and two decks of playing cards used in games such as double deck blackjack. Many other specialty games may use single or multiple decks of cards, with or without jokers and with or without selected cards removed.

Card shuffling devices are used to assist, enhance, and/or secure the play of card-based games. At least some gaming tables for play of these card-based games have slots or installation points that receive a card shuffling device, thereby bringing the shuffling device closer to the game participants and create the appearance of the integration between the shuffling device and the gaming table. The gaming industry continues to seek improvements to card shuffling devices that increase their benefit to players, dealers, and operators. However, the addition of such improvements to the card shuffling devices may result in increased weight and/or complexity of the shuffling devices. The increased weight may cause strain on a gaming table fully supporting the shuffling devices as well as operators that install, maintain, and remove the shuffling devices. For example, to install a shuffling device, an operator may be required to move the shuffling device to its destination gaming table, lift the shuffling device, align the shuffling device above the installation point of the gaming table, and lower the shuffling device into the installation point. As a result, improvements to systems and methods for transporting and supporting card shuffling devices are needed.

BRIEF SUMMARY

Some embodiments of the present disclosure may include a card shuffler system includes an automatic card shuffler for shuffling playing cards and a shuffler transport device coupled to the automatic card shuffler to move and support the automatic card shuffler. The shuffler transport device includes a base assembly for moving along a ground surface, a vertical support, and an adjustment assembly coupled to the vertical support. The vertical support extends from the base assembly and is coupled to the automatic card shuffler to cantilever the automatic card shuffler over the base assembly. The adjustment assembly adjusts the height of the automatic card shuffler between at least a first height and a second height along a vertical axis.

Some embodiments of the present disclosure may include a method for installing an automatic card shuffler at a gaming table using a shuffler transport device. The shuffler transport device includes a base assembly moveable along a ground surface, a vertical support extending from the base assembly and coupled to the automatic card shuffler, and an adjustment assembly. The method includes moving, by the shuffler transport device, the automatic card shuffler towards an installation point at the gaming table, the automatic card shuffler extending from the vertical support and cantilevered over the base assembly. The method further includes adjusting, by the adjustment assembly, a height of the automatic card shuffler to engage an installation surface of the installation point such that the installation surface supports the automatic card shuffler, and installing, by the shuffler transport device, the automatic card shuffler at the installation point for play of a card-based game at the gaming table.

Some embodiments of the present disclosure may include an automatic card shuffler for shuffling playing cards, the automatic card shuffler including a housing and a shuffler transport device coupled to the housing to move and support the automatic card shuffler. The shuffler transport device includes a base assembly for moving the transport device along a ground surface, a vertical support extending from the base assembly, and an adjustment assembly coupled to the vertical support. The vertical support is coupled to the housing to cantilever the automatic card shuffler over the base assembly. The adjustment assembly adjusts the height of the automatic card shuffler between at least a first height and a second height along a vertical axis.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

FIG. 8 is a flow diagram of an example installation method for installing a card shuffler at a gaming table using a shuffler transport device according to at least some embodiments of the present disclosure.

Figure 1:
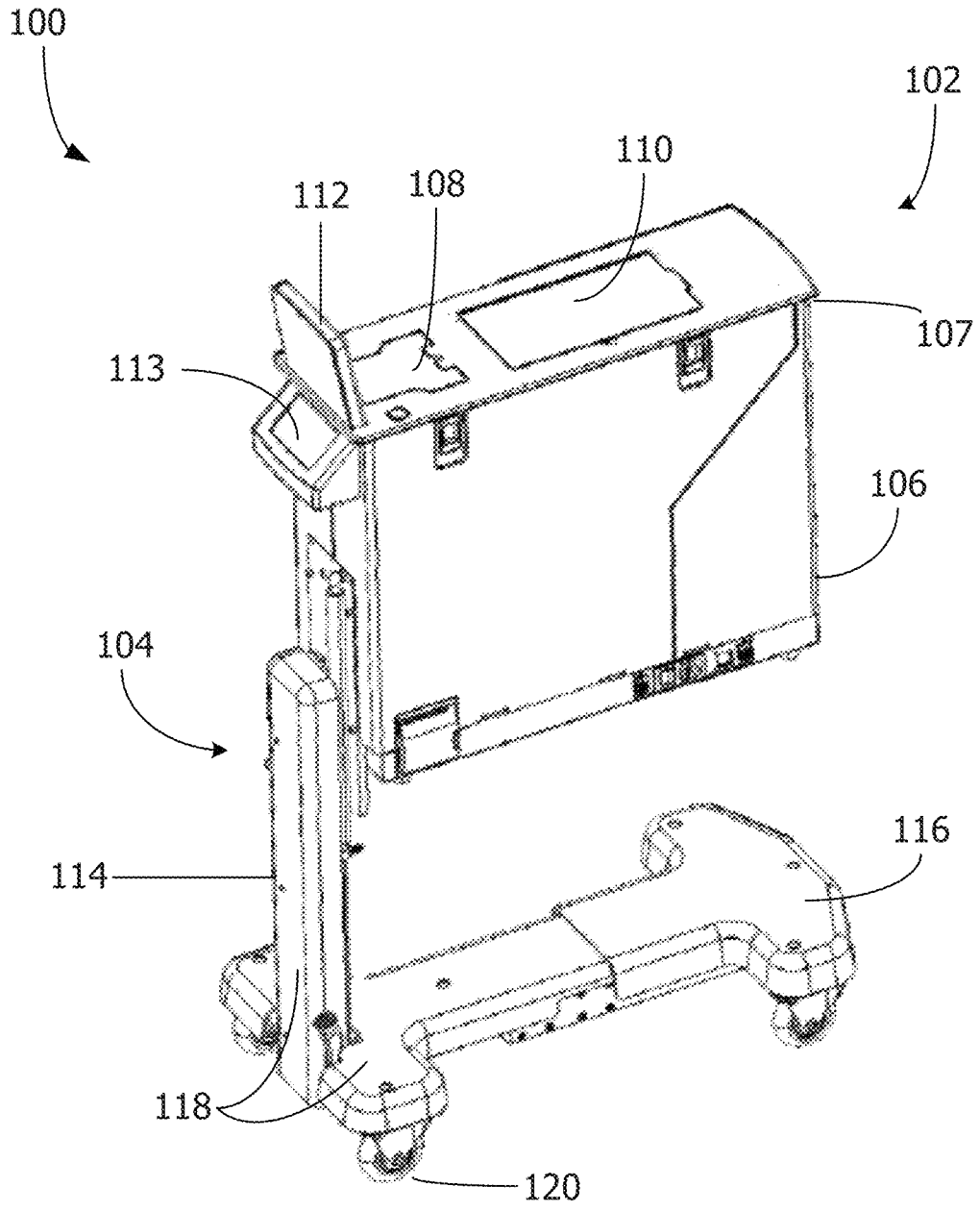
FIG. 1 is a perspective view of an example card shuffling system according to at least some embodiments of the present disclosure.

The illustrations presented herein are not meant to be actual views of any particular card shuffling system or component thereof, but are merely idealized representations employed to describe illustrative embodiments. The drawings are not necessarily to scale. Elements common between figures may retain the same numerical designation.

DETAILED DESCRIPTION

As used herein, any relational term, such as "first," "second," "over," "beneath," "top," "bottom," "underlying," "up," "down," etc., is used for clarity and convenience in understanding the disclosure and accompanying drawings, and does not connote or depend on any specific preference, orientation, or order, except where the context clearly indicates otherwise. For example, these terms may refer to an orientation of elements of the card handling device and/or the transport device relative to a surface of a table on which the card handling device and/or the transport device may be positioned, mounted, and/or operated (e.g., as illustrated in the figures).

As used herein, the terms "vertical" and "horizontal" may refer to a drawing figure as oriented on the drawing sheet, and are in no way limiting of orientation of an apparatus, or any portion thereof, unless it is apparent that a particular orientation of the apparatus is necessary or desirable for operation in view of gravitational forces. For example, when referring to elements illustrated in the figures, the terms "vertical" or "horizontal" may refer to an orientation of elements of the card handling device relative to a table surface of a table to which the card handling device may be mounted and operated.

As used herein, the term "and/or" means and includes any and all combinations of one or more of the associated listed items.

As used herein, the terms "substantially," "approximately," or "about" in reference to a given parameter means and includes to a degree that one skilled in the art would understand that the given parameter, property, or condition is met with a degree of variance, such as within acceptable manufacturing tolerances, or wherein the variance is with respect to a general parameter, such as an orientation. For example, a parameter that is substantially met may be at least about 90% met, at least about 95% met, or even at least about 99% met.

As used herein, a "height" of an object refers to distance measurement between the object and a reference surface (e.g., a ground surface or other object) rather than a dimension of the object itself. The height may not be measured from an extremity of the object (e.g., a topmost or bottommost surface), but may be measured from a point having functional importance to the height described herein. For example, a gaming table may include a slot or installation point that engages a lip or edge of a card shuffler to support the shuffler such that a portion of the shuffler is above a playing surface of the table and another portion is below the playing surface. In such an example, the height of the card shuffler may be the distance from the lip to the ground surface, and the height of the installation point of the table may be the distance from the surface that engages the lip to the ground surface. In certain embodiments, the systems and methods described herein may not be limited to gaming devices. For example, the transportation and support systems described herein may be used for terminals, kiosks, signage, and the like.

Although the systems and methods described herein refer specifically to a card shuffler device, it is to be understood that other gaming-related devices may be substituted for the shuffler device. That is, other gaming devices that benefit from a transportation and/or support from a transport device as described herein may be coupled to the transport device. In some embodiments, the transport device may be configured to selectively couple to shuffler devices and/or other gaming devices such that the transport device may be used with a variety of gaming devices.

FIG. 1 is a perspective view of an example card shuffler system 100. The card shuffler system 100 includes an automatic card shuffler 102 and a shuffler transport device 104 coupled to the automatic card shuffler 102. In other embodiments, the system 100 may include additional, fewer, or alternative components, including those described elsewhere herein.

The automatic card shuffler 102 is configured to facilitate play of one or more card-based games, including, for example, wagering games like poker, blackjack, baccarat, and the like. More particularly, the automatic card shuffler 102 is configured to receive one or more playing cards in a first sequence, reorganize the received playing cards into a second sequence (i.e., shuffle the cards), and selectively dispense the reorganized playing cards. These functions may be at least partially performed automatically. That is, a dealer may provide some input to the card shuffler 102 to initiate the intake, shuffling, and/or dispense of the playing cards.

In the example embodiment, the automatic card shuffler 102 includes a housing 106, a card input area 108, a card output area 110, and a display 112. The housing 106 defines the exterior of the card shuffler 102 and protects internal components of the automatic card shuffler 102. The housing 106 may include one or more features for securing the card shuffler 102 to a gaming table, a supporting device (e.g., the transport device 104), and/or another suitable device. The features may include, but are not limited to, lips, grooves, hooks, brackets, fasteners, fastener openings, and/or legs. In the example embodiment, the housing 106 includes a lip 107 for mounting the automatic card shuffler 102 to a gaming table as described below in FIG. 3.

Playing cards are inserted into the card shuffler 102 at the card input area 108, and shuffled playing cards are dispensed from the card output area 110. At least one card path through the automatic card shuffler 102 may be defined between the card input area 108 and the card output area 110. A "card path" is used herein to refer to the path followed by at least one card through the shuffler 102. In certain embodiments, the card input area 108 and the card output area 110 may appear to be combined from an external viewpoint of the shuffler 102. That is, in such embodiments, the card input area 108 and the card output area 110 may receive or dispense cards, respectively, from the same or a similar position on the housing 106, yet these card areas 108, 110 are separate along the defined card paths internally.

The display 112 is configured to present information associated with the automatic card shuffler and/or one or more card-based games to the dealer and/or any players at a gaming table. The display 112 may include a touchscreen for receiving user input. In at least some embodiments, the shuffler may also include a back display 113 similar to the display 112. The inclusion of two displays may facilitate segregation of presented data and/or control options between the display 112 and the back display 113. For example, the display 112 may display information to players, while the back display 113, which may not be readily visible to the players, may display status information to a dealer or a maintenance operator.

Figure 2:
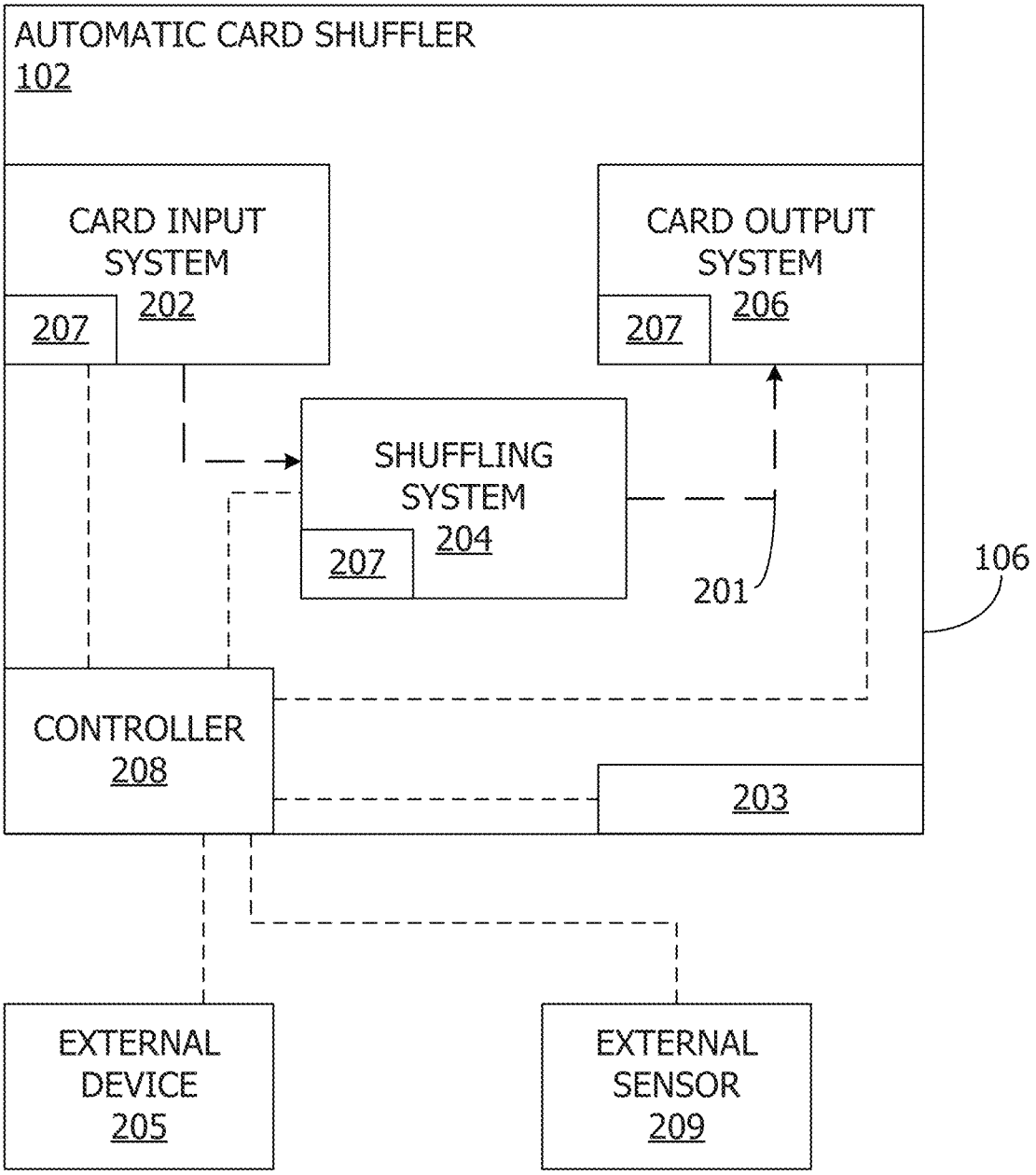
FIG. 2 is a block diagram of an example automatic card shuffler according to at least some embodiments of the present disclosure.

FIG. 2 is a block diagram illustrating example internal components of the automatic card shuffler 102. In the example embodiment, the internal components include a card input system 202, a shuffling system 204, a card output system 206, and a controller 208. In other embodiments, the shuffler 102 may include additional, fewer, or alternative internal components, including those described elsewhere herein.

The card input system 202 is configured to receive playing cards from the card input area 108 and move the received cards along one or more card paths 201 defined through the shuffler. In the example embodiment, the card path is defined such that a received playing card travels, in order, from the card input system 202 to the shuffling system 204, and finally to the card output system 206. The card input system 202 may include any suitable components for moving, separating, and/or organizing the received playing cards. For example, the card input system 202 may include a series of rollers, arms, and the like to pull cards from the card input area 108 to the shuffling system 204.

The shuffling system 204 is configured to collect the playing cards from the card input system 202 in a first sequence and reorganize the playing cards into a second sequence. The shuffling system 204 may include any suitable components in one or more configurations to change the sequence of the playing cards (i.e., shuffle the cards). For example, the shuffling system 204 may include a wheel with a plurality of compartments for receiving playing cards and selectively dispensing the cards to the card output system 206. In another example, the shuffling system 204 may include one or more arms or rollers that selectively remove one or more cards from a group of cards for delivery to the card output system 206. In further examples, the shuffling system 204 may include shuffling mechanisms such as those disclosed in U.S. Pat. No. 5,676,372 to Sines et al. that issued Oct. 14, 1997, U.S. Pat. No. 6,254,096 to Grauzer et al. that issued Jul. 3, 2001, U.S. Pat. No. 6,651,981 to Grauzer et al. that issued Nov. 25, 2003, and U.S. Pat. No. 6,659,460 to Blaha et al. that issued Dec. 9, 2003, the disclosures of each of which are incorporated herein in their entireties by this reference.

The card output system 206 may be similar to card input system 202 such that the card output system 206 is configured to move playing cards along the card path 201. More particularly, the card output system 206 is configured to move playing cards from the shuffling system 204 to the card output area 110. In certain embodiments, the card output system 206 may be configured to store the shuffled playing cards temporarily until the playing cards are to be dispensed. In other embodiments, the shuffling system 204 may be configured to store the playing cards until the playing cards are to be dispensed.

In the example embodiment, the controller 208 is configured to facilitate automated operation of the card shuffler 102 and provide other functionalities associated with the shuffler, such as, but not limited to, monitor gameplay for a game incorporating the shuffler 102, collect and/or report accounting information (e.g., wager amounts, payouts, etc.). The controller 208 may be communicatively coupled (i.e., via wired and/or wireless data communication) to the card input system 202, the shuffling system 204, and/or the card output system 206 to control the operation of the shuffler 102. That is, the internal components of the shuffler 102 may be operated in response to control signals from the controller 208. Other components of the shuffler 102 and/or other devices may also be communicatively coupled to the controller 208 to receive and/or send data signals, such as, but not limited to, input/output (I/O) devices 203 and/or an external device 205.

The I/O devices 203 are configured to receive user input for the controller 208 and present outputs from the controller 208 to a user. The I/O devices 203 may include, for example, buttons, touchscreens, dials, speakers, and/or the display 112. The external device 205 may be any suitable device that communicates with the controller 208 to exchange data associated with the shuffler 102 and/or the current game using the shuffler 102. In one example, the external device 205 is an interface operated by a dealer. In another example, the external device is a server-based accounting system that collects accounting information from the controller 208. Although one external device is shown, the controller 208 may be configured to communicate with a plurality of external devices 205.

In certain embodiments, to monitor the shuffler 102 and/or the game using the shuffler 102, the controller 208 may be communicatively coupled to one or more sensors. Any suitable type of sensor may be used, such as, but not limited to, image sensors, weight sensors, motion sensors, strain sensors, and the like. In the example embodiment, the controller 208 is communicatively coupled to a plurality of internal sensors 207 and a plurality of external sensors 209. The internal sensors 207 monitor the playing cards and the internal components. In one example, the internal sensors 207 include at least one image sensor (i.e., a camera) that monitors the playing cards through the card path 201 such that the controller 208 can track and/or change the sequence of the cards via the shuffling system 204. The image sensors may include, for example, the imaging devices described in U.S. Pat. No. 7,933,448 to Downs, issued Apr. 26, 2011, in U.S. Pat. No. 7,764,836 to Downs et al., issued Jul. 27, 2010, or in U.S. Pat. No. 8,800,993 B2 to Blaha et al., issued Aug. 12, 2014, the disclosure of each of which is incorporated herein in its entirety by this reference. The external sensors 209 may be configured to monitor the environment of the shuffler 102. For example, the external sensors 209 may include one or more cameras monitoring a playing area used in conjunction with the shuffler 102 and one or more sensors that monitor wagers from players.

With respect again to FIG. 1, the internal components of the shuffler 102 may impact the weight, fragility, and/or complexity of the shuffler 102, which may cause the installation of the shuffler 102 to become cumbersome and difficult when done manually. Accordingly, the transport device 104 of the system 100 is configured to attach to the housing 106 of the card shuffler 102 and to support the shuffler 102 during (and, in some embodiments, after) transportation to an installation point, such as a gaming table. In addition to supporting the shuffler 102, the transport device 104 includes features described herein that facilitate ease of installation at a mounting or installation point of a gaming table. More particularly, in the example embodiment as described in further detail below, the transport device 104 has three features for ease of installation: (i) a cantilevered support configuration, (ii) a compressible base to move the shuffler along a horizontal axis, and (iii) an adjustment assembly to move the shuffler 102 vertically into the installation point.

In at least some embodiments, after installing the shuffler 102 at a gaming table, the transport device 104 may remain attached to the shuffler 102 to provide additional support while the shuffler 102 is in use. Additionally, by remaining attached to the shuffler 102, the removal process of the shuffler 102 from the gaming table (e.g., for maintenance, storage, reorganization, etc.) may be made easier for an operator. That is, rather than locate, retrieve, and attach a spare transport device 104 to the shuffler 102, the operator may simply begin the removal process immediately at the gaming table. In other embodiments, the transport device 104 may be selectively removable from the shuffler 102 for use with a plurality of devices (including other shufflers 102). In such embodiments, one or more support devices may be attached to the shuffler 102 in place of the transport device 104.

In the example embodiment, the transport device 104 includes a support member 114, a base assembly 116, and one or more cover members 118. The support member 114 is configured to be coupled to the automatic card shuffler 102. As described in detail further below, the support member 114 may be configured to selectively adjust the shuffler 102 along a vertical axis to facilitate installation of the shuffler 102. The support member 114 extends vertically from one end of the base assembly 116 such that the shuffler 102 is cantilevered over the base assembly 116. In other embodiments, the support member 114 may extend from the base assembly 116 in a different configuration. For example, the support member 114 may extend diagonally from the base assembly 116 or extend vertically from the center of the base assembly 116.

The base assembly 116 is configured to bear at least a portion of the load from the support member 114 and to facilitate movement of the transport device. In the example embodiment, the base assembly 116 includes a plurality of wheels 120 that enable the transport device 104 to be moved without requiring an operator to lift the automatic shuffler 102 during transport. It is to be understood that, in other embodiments, the base assembly 116 may include additional, fewer, or alternative wheels and/or other elements to facilitate movement of the transport device. In one example, the base assembly 116 may include additional wheels 120. In another example, ball wheel casters may be used instead of the wheels 120.

In the example embodiment, substantial portions of the transport device 104 are covered by the cover members 118. The cover members 118 protect the underlying components, and, in some embodiments, incorporate visual elements to, for example, blend into its environment or attract potential players to the gaming table. The transport device 104 may include any suitable number (including one) and/or configuration of cover members 118.

Figure 3:
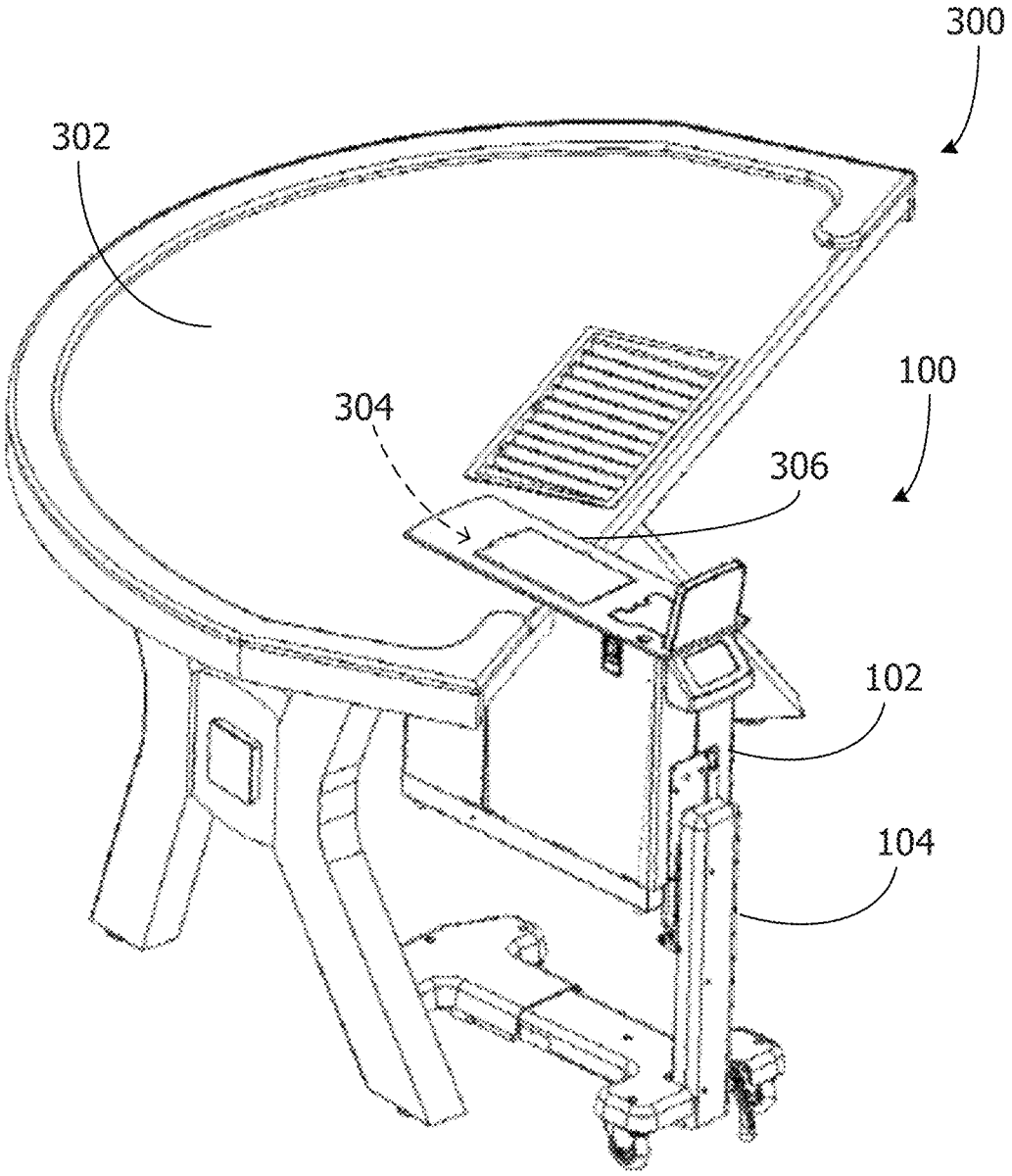
FIG. 3 is a perspective view of an example automatic card shuffler installed at a gaming table according to at least some embodiments of the present disclosure.
Figure 4:
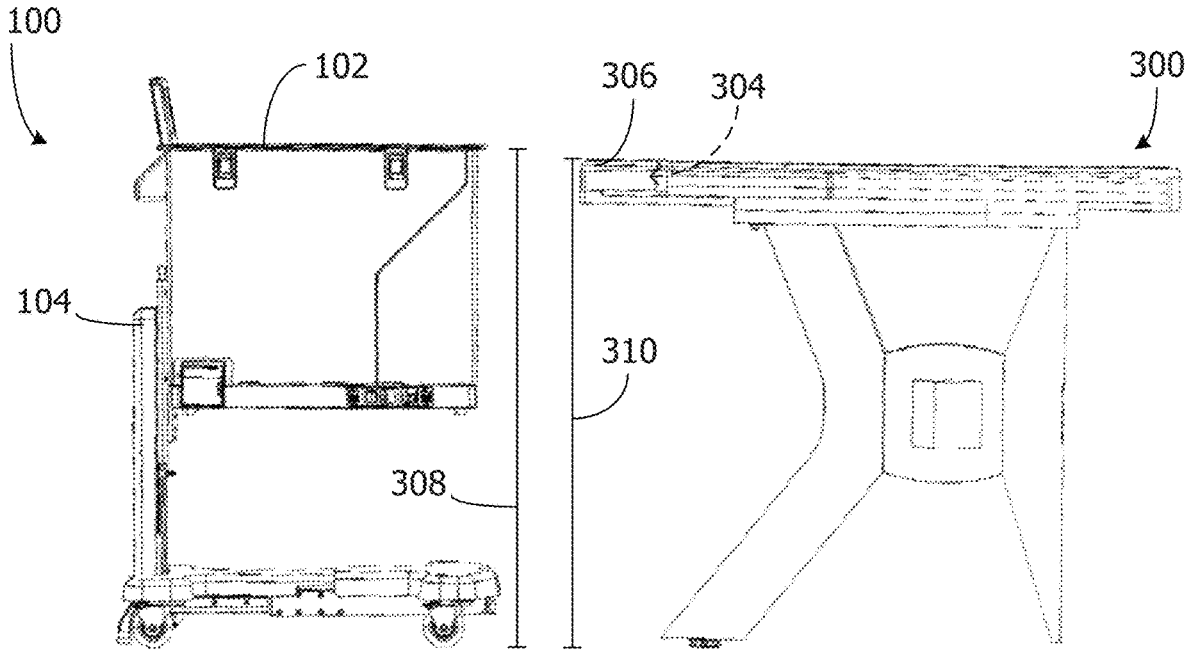
FIG. 4 is a cross section of the automatic card shuffler and gaming table shown in FIG. 3 according to at least some embodiments of the present disclosure.

FIGS. 3 and 4 illustrate the card shuffler system 100 at an installation point. More particularly, the system 100 is positioned at an example gaming table 300 for installation. FIG. 3 is a perspective view of the system 100 and the table 300, and FIG. 4 is a side cross-sectional view of the system 100 and the table 300. In other embodiments, the installation point may be located at a different gaming table or another suitable system or device.

The gaming table 300 includes a playing surface 302 for play of a game and a mounting point 304 for receiving the automatic card shuffler 102 (i.e., the installation point). In some embodiments, the gaming table 300 may include additional features for supporting one or more devices that facilitate gameplay, such as a dealer interface or player interfaces.

In the example embodiment, the mounting point 304 is a cut-out in the gaming table 300. When the automatic card shuffler 102 is mounted within the mounting point 304, the upper surface of the card shuffler 102 (i.e., the card input area 108 and the card output area 110) appears to be substantially integrated with the playing surface. In addition, mounting the shuffler 102 within the table 300 also may reduce the overall footprint of the table 300 and system 100 combined, thereby freeing up additional floor space for other uses (e.g., walkways, additional tables, additional seating, etc.). In other embodiments, the installation point at the gaming table 300 may have a different configuration. For example, other suitable installation points may include brackets, extensions, and the like for supporting one or more surfaces of the shuffler 102.

The mounting point 304 includes an installation surface 306 configured to engage the shuffler 102 when the shuffler 102 is engaged. The installation surface 306 may be part of the playing surface 302 or a different surface. For example, the installation surface 306 may be a padded surface lining a perimeter of the mounting point 304. In the example embodiment, to install the shuffler 102 at the mounting point 304, the lip 107 (shown in FIG. 1) of the shuffler 102 engages the installation surface 306. As used herein, when the lip 107 is engaged with the installation surface 306, a height 308 of the shuffler 102 and a height 310 of the installation surface 306 are considered to be "matched" or matching heights (both shown in FIG. 4). That is, the heights 308, 310 may be the same or substantially similar when the shuffler 102 is installed at the mounting point 304.

In the example embodiment, as described in further detail herein, the shuffler 102 may be raised above the mounting point 304 and lowered to match the shuffler height 308 to the installation surface height 310. Previous installation methods may require one or more operators to manually lift the shuffler 102 to a height above the mounting point 304 and lower the shuffler to match the installation surface height 310. In other embodiments, the shuffler height 308 may be adjusted to match the installation surface height 310 prior to vertical alignment with the mounting point 304 such that the shuffler 102 is slid into the mounting point 304.

To facilitate the height adjustment of the shuffler 102, the transport device 104 is configured to enable an operator to adjust the shuffler height 308 via the transport device 104 while the transport device 104 bears the load of the shuffler 102. In at least some embodiments, the transport device 104 includes one or more features that secure the shuffler 102 at the mounting point 304. For example, the transport device 104 may include one or more brakes to secure the shuffler height 308 and prevent the transport device (and the shuffler 102) from moving away from the mounting point 304.

Figure 5:
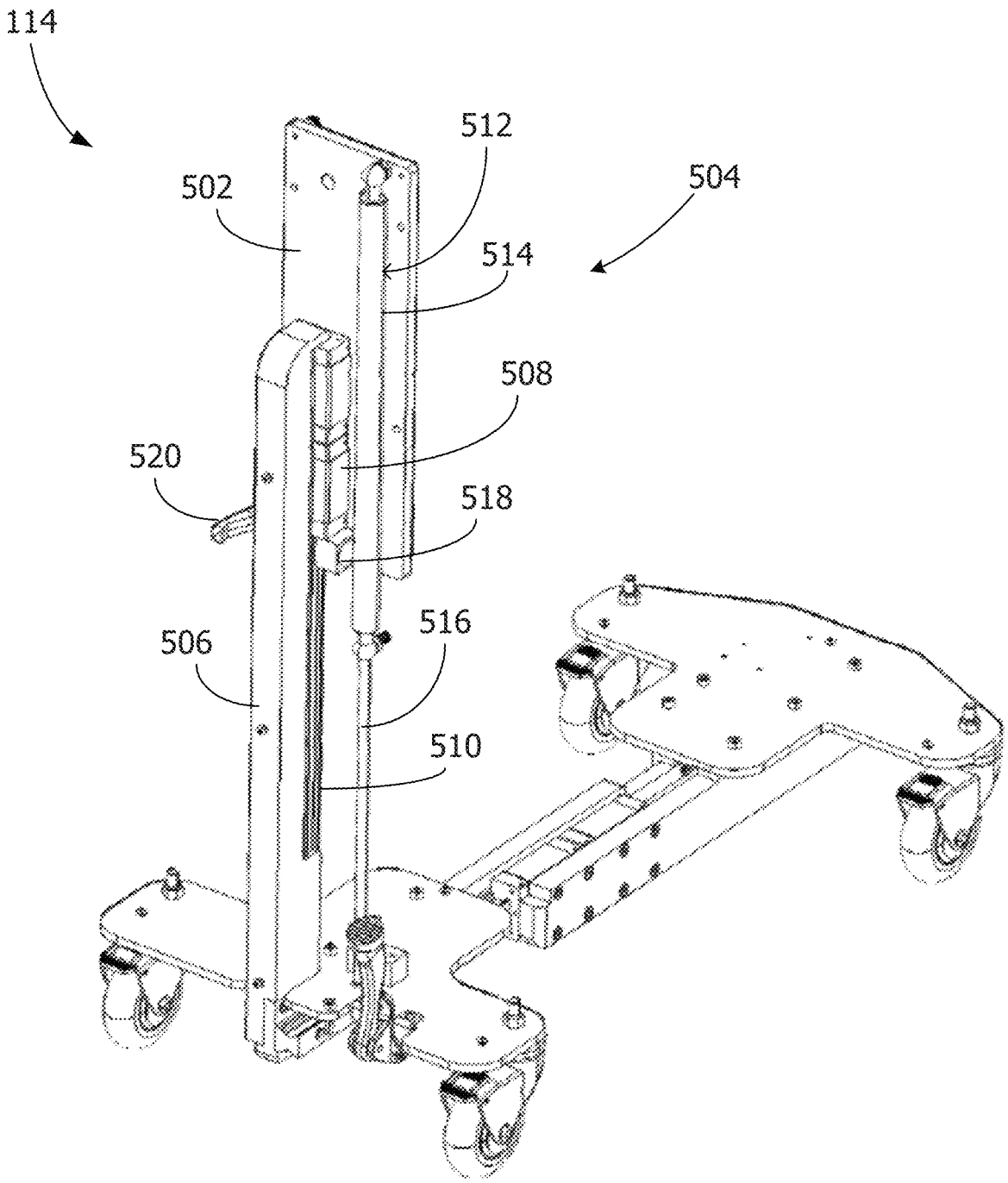
FIG. 5 is a perspective view of an example shuffler transport device according to at least some embodiments of the present disclosure.

FIG. 5 is a perspective view of the shuffler transport device 104 with the cover members 118 (shown in FIG. 1) removed for clarity purposes. In particular, in the example embodiment, removal of the cover members 118 exposes the base assembly 116, the support member 114, a mount plate 502, and an adjustment assembly 504.

The mount plate 502 is coupled between the support member 114 and the automatic card shuffler 102. The mount plate 502 may include one or more features that facilitate securing the transport device 104 to the shuffler. For example, and without limitation, the mount plate 502 may include fasteners, fastener openings aligning with similar openings on the shuffler, brackets, rails, arms, and the like to secure the shuffler 102 and the transport device 104 together. In other embodiments, the transport device 104 may not include the mount plate 502. In such embodiments, the support member 114 may couple directly to the shuffler 102.

The adjustment assembly 504 may be coupled to the shuffler 102, the base assembly 116, the support member 114, and/or the mount plate 502. In the example embodiment, the adjustment assembly 504 is coupled to the mount plate 502. As sometimes used herein, the adjustment assembly 504 may be referred to as "coupled to" the shuffler 102 to include both directly coupling to the shuffler 102 and indirect coupling to the shuffler (e.g., via the mount plate 502). The adjustment assembly 504 is configured to facilitate movement of the shuffler 102 along a substantially vertical axis (relative to a ground surface). In some embodiments, the adjustment assembly 504 may be configured to adjust a vertical length of the support member 114, thereby adjusting the height of the shuffler 102 as a function of the vertical length of the support member 114. In such embodiments, the support member 114 may have any suitable configuration that facilitates an adjustable length, such as, for example, a telescoping body or other configurations of slidably coupled segments. In other embodiments, the vertical length of the support member 114 may be fixed, and the mount plate 502 is configured to move within the length of the support member 114 in response to a change in the adjustment assembly 504.

In the example embodiment, the vertical length of the support member 114 is fixed, and the support member 114 includes a body 506 and a cartridge 508 slidably coupled to the body. In particular, the body 506 defines a support rail guide 510 coupled a portion of the cartridge 508 while enabling the cartridge 508 to slide along the support rail guide 510. The support rail guide 510 may be defined along at least a portion of the vertical length of the support member 114. The length of the support rail guide 510 may restrict the movement of the cartridge 508 between a predetermined maximum height (i.e., the uppermost end of the support rail guide 510) and a predetermined minimum height (i.e., the lowermost end of the support rail guide 510). The cartridge 508 is coupled to the mount plate 502 (and, by extension, the shuffler 102) such that movement of the cartridge 508 on the support rail guide 510 causes the height of the shuffler 102 to be adjusted. As used herein, the predetermined maximum and minimum heights may not only refer to the height of the cartridge 508, but also the height of the shuffler 102 when coupled to the cartridge 508. The adjustment assembly 504 is configured to cause the cartridge 508 to move along the support rail guide 510 and adjust the height of the shuffler 102.

In the example embodiment, the adjustment assembly 504 includes a gas spring mechanism 512 coupled to the mount plate 502. The gas spring mechanism 512 is configured to apply a relative upward bias force on the mount plate 502. The magnitude of the bias force is at least partially a function of the pneumatically stored potential energy of the gas spring mechanism 512. More particularly, the gas spring mechanism 512 includes a cylinder 514 and a piston 516 that seals a gas within the cylinder. When the piston 516 moves relative to the cylinder 514 (or the cylinder 514 moves relative to the piston 516 as in the example embodiment), the internal gas is selectively compressed, and the potential energy of the gas spring mechanism 512 changes. If the gas is compressed further, more potential energy is stored by the gas spring mechanism 512. Conversely, if the gas is decompressed by moving the piston 516 away from the cylinder 514, at least a portion of the stored potential energy is consumed as the bias force.

In other embodiments, other suitable adjustment assemblies 504 may be used to perform the functionalities of the gas spring mechanism 512. For example, spring mechanisms other than gas springs, counterweights, and/or electric motors may be used. In another example, a segmented adjustment assembly 504 with a telescoping body may be used to adjust the height of the shuffler 102. In further embodiments, a plurality of adjustment assemblies 504 and/or a plurality of underlying components may be included in the transport device. For example, the adjustment assembly 504 may include another gas spring mechanism 512 in some embodiments.

In the example embodiment, movement of the mount plate 502, the cartridge 508, and the shuffler 102 is at least partially a function of the magnitude of the bias force. More specifically, the movement of the cartridge 508 within the support rail guide 510 is a function of any downward forces (e.g., gravity and friction between the cartridge 508 and the support rail guide 510) comparative to the bias force of the gas spring mechanism 512 and any other upward forces (e.g., friction and a manual force applied by an operator). If the magnitude of the bias force exceeds the magnitude of the downward forces, the cartridge 508 may move upward within the support rail guide 510. Conversely, if the magnitude of the downward forces exceeds the magnitude of the bias force, the cartridge 508 may move downward within the support rail guide 510. In certain embodiments, an operator may selectively apply a downward or upward force to adjust the height of the shuffler 102 via the cartridge 508 without requiring the operator to bear a substantial portion of the weight of the shuffler 102. That is, the gas spring mechanism 512 may assist in bearing a substantial portion of weight of the shuffler 102, particularly during an installation process of the shuffler 102 that includes vertical movement of the shuffler 102. In at least some embodiments, if movement of the cartridge 508 within the support rail guide 510 is unrestricted (i.e., no brakes or outside forces have been applied), the gas spring mechanism 512 may be configured to reach an equilibrium state over time. In the equilibrium state, the upward and downward forces on the cartridge 508 are substantially equal, and therefore the cartridge 508 (and the shuffler 102) remain in substantially the same position until a change occurs in the forces applied to the cartridge 508.

In at least some embodiments, the support member 114, the mount plate 502, and/or the adjustment assembly 504 may include one or more restraint devices 518 or brakes that secure the cartridge 508 and/or the shuffler 102 at a particular height. In the example embodiment, the restraint device 518 is integrated with the mount plate 502 and is coupled to the support rail guide 510. The restraint device 518 selectively engages one or more surfaces within the support rail guide 510 to prevent the mount plate 502 (and by extension, the cartridge 508) from moving relative to the support member 114. In at least some embodiments, the restraint device 518 includes a handle 520 or other component to enable an operator to selectively engage or disengage the restraint device 518. In other embodiments, the restraint device 518 may have another suitable configuration and/or components that enable the restraint device 518 to selectively prevent movement of the cartridge 508 and the shuffler 102.

The restraint device 518 may be used, for example, during an installation process of the shuffler 102 to adjust the shuffler 102 to height above the installation point and maintain the height until the shuffler 102 is vertically aligned with the installation point. As a result, the installation process may be broken into two primary steps: (i) vertical alignment of the shuffler 102 with the installation point, and (ii) matching the height of the shuffler 102 to the height of an installation surface (e.g., the installation surface 306, shown in FIGS. 3 and 4). The two-step installation process may be comparatively less cumbersome and straining than a manual installation in which vertical alignment and height adjustment may addressed simultaneously by the operator installing the shuffler 102. In at least some embodiments, the base assembly 116 may include one or more features to assist with the vertical alignment of the shuffler 102.

Figure 6:
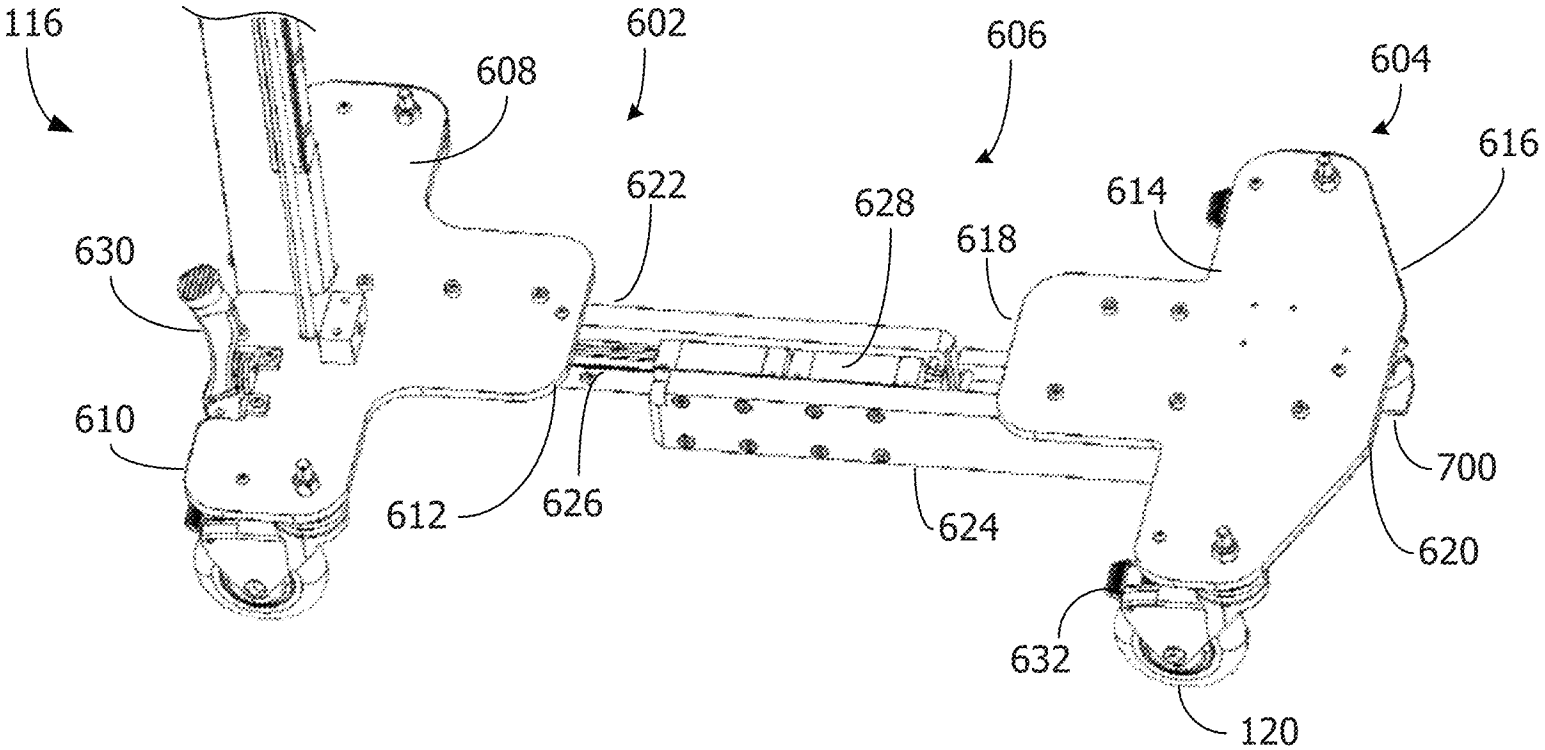
FIG. 6 is a perspective view of an example base assembly of a shuffler transport device according to at least some embodiments of the present disclosure.

FIG. 6 is a close-up perspective view of the base assembly 116 of the shuffler transport device 104 shown in FIG. 1. In the example embodiment, the base assembly 116 includes wheels 120, a first base member 602, a second base member 604, and an extension assembly 606. In other embodiments, the base assembly 116 may include additional, fewer, or alternative components, including those described elsewhere herein.

The first base member 602 includes a first base plate 608 having a first end 610 of the base assembly 116 and a first internal edge 612. The first base plate 608 is configured to secure other parts of the transport device 104 and the base assembly 116 together. In at least some embodiments, the first base plate 608 is configured to assist in weight distribution and/or load-bearing to prevent the transport device 104 and the coupled shuffler 102 from tipping during transport and/or installation. In the example embodiment, the support member 114 extends from the first end 610. The first end 610 may be referred to herein as the "back end" of the transport device 104 due to the relative orientation of the transport device 104 when the shuffler 102 is installed at a gaming table, i.e., the first end 610 faces away from the gaming table and the direction of movement during the installation of the shuffler 102.

The second base member 604 includes a second base plate 614 having a second end 616 and a second internal edge 618. The second base plate 614 is configured similar to the first base plate 608, but includes a leading edge 620 at the second end 616 rather than the support member 114. The second end 616 is opposite of the first end 610, and, for similar reasons as the first end 610, may be referred to herein as the "front end." The leading edge 620 may be used as described herein to guide the transport device 104 to vertically align the shuffler 102 with an installation point. More particularly, the leading edge 620 may be used to selectively engage the extension assembly 606 to move the shuffler 102 towards an installation point.

The extension assembly 606 is configured to facilitate horizontal movement (relative to the ground surface underneath the transport device 104) of the shuffler 102 for vertically aligning the shuffler 102 with an installation point (e.g., mounting point 304, shown in FIG. 3). More particularly, the extension assembly 606 is configured to selectively compress, which may cause the shuffler 102 to be moved horizontally. In the example embodiment, the extension assembly 606 includes a first rail member 622, a second rail member 624, a rail channel 626, and one or more rail guides 628. The first base member 602 includes the first rail member 622 and the rail channel 626, while the second base member 604 includes the second rail member 624 and the rail guides 628. In other embodiments, the extension assembly 606 may include additional, fewer, or alternative components, including those described elsewhere herein. In one example, the extension assembly 606 may include a gas spring mechanism rather than (or in combination with) a rail-based mechanism.

The first and second rail members 622, 624 are elongated members that extend parallel to each other from the respective base members (i.e., the first and second base members 602, 604, respectively). The rail channel 626 and the rail guides 628 are coupled together between the rail members 622, 624. More particularly, the rail channel 626 and the rail guides 628 are slidably coupled together to facilitate selectively extension or compression of the extension assembly 606. As the extension assembly 606 compresses, the internal edges 612, 618 move towards each other, and the overall footprint of the transport device 104 is reduced. Reducing the footprint of the transport device 104 may enable the transport device 104 to install the shuffler 102 into areas with limited space, such as, but not limited to, installation points at gaming tables.

In the example embodiment, the extension assembly 606 may be configured to be in an extended position during transportation of the shuffler 102 to increase the stability of the transport device 104. As used herein, the terms "compressed position" and "extended position" are used relative to each other, and are not limited to positions of maximum compression and extension of the extension assembly 606, respectively. For example, some installation points may require the extension assembly 606 to be compressed only partially to the full extent of the compression capable by the extension assembly 606.

In at least some embodiments, the extension assembly 606 includes a locking mechanism to selectively prevent the base assembly from compressing from an extended position. In certain embodiments, the compression may be unlocked in response to the locking mechanism being disengaged by an operator and/or by engaging an external mechanism, such as a mechanism attached to a gaming table at an installation point.

Figure 7:
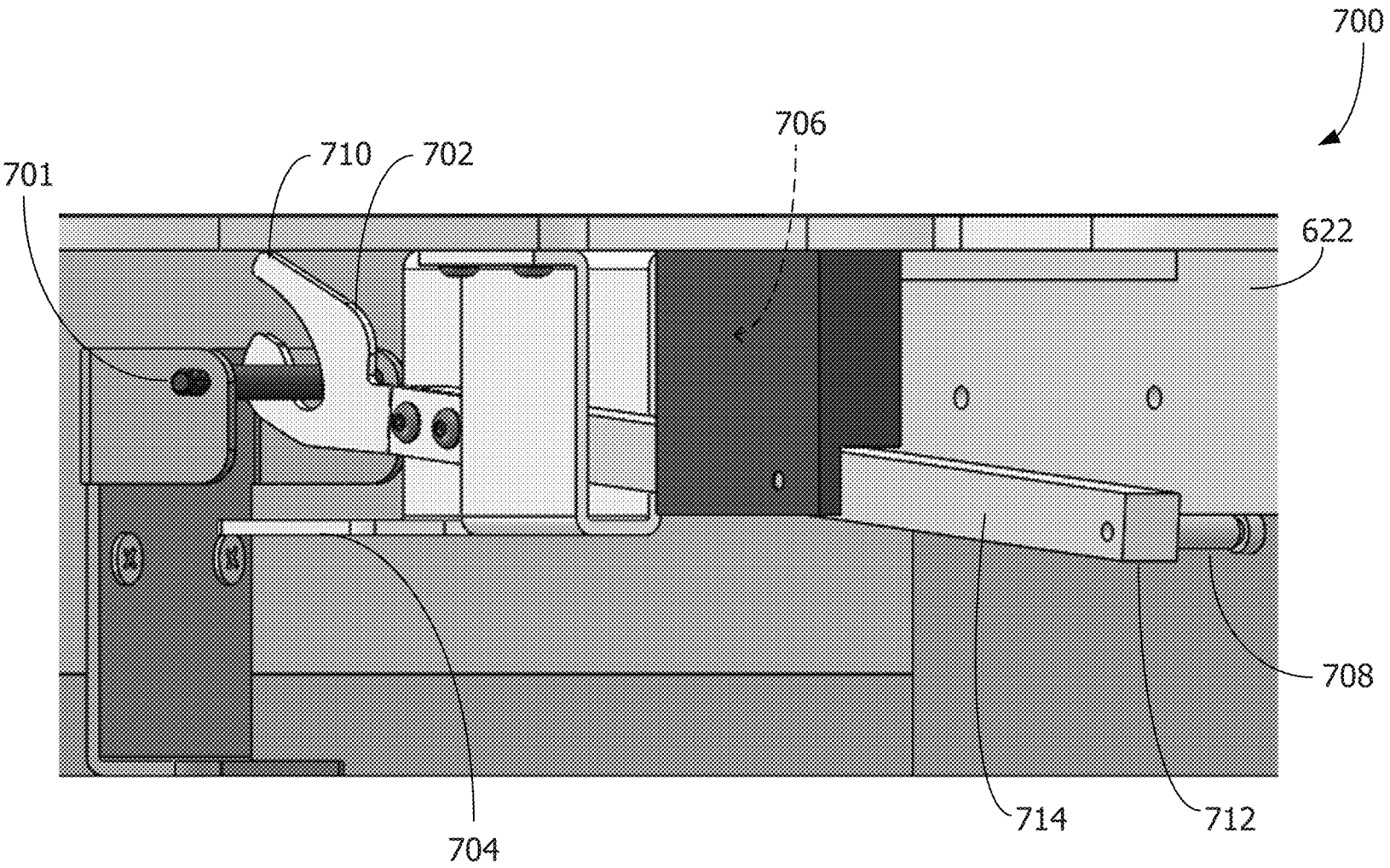
FIG. 7 is a perspective view of an example locking mechanism for a shuffler transport device according to at least some embodiments of the present disclosure.

FIG. 7 is a perspective view of an example locking mechanism 700 that may be used in combination with the extension assembly 606 (shown in FIG. 6). The locking mechanism 700 is configured to engage a receiver bracket 701 that is attached to the gaming table 300 (shown in FIG. 3). The locking mechanism 700 includes an engagement lever 702, a guard 704, a compression spring 706, and a sleeve bearing 708. In other embodiments, the locking mechanism 700 and/or the receiver bracket 701 may include additional, fewer, or alternative components, including those described elsewhere herein.

The engagement lever 702 includes a first end 710, a second end 712, and a body 714 extending between the first and second ends 710, 712. The first end is configured to mate with the receiver bracket 701 such that mating with the receiver bracket 701 causes the engagement lever 702 to move and unlock the extension assembly 606. In the example embodiment, the first end 710 of the engagement lever 702 moves upward in response to coupling to the receiver bracket 701. In other embodiments, the engagement lever 702 is configured to move in a different direction in response to coupling with the receiver bracket 701. The guard 704 is positioned below the first end 710 to prevent the engagement lever 702 from moving during transportation. In embodiments in which the engagement lever 702 moves in a different direction, the guard 704 may be repositioned and/or reconfigured to prevent errant movement of the lever 702 in that direction.

The compression spring 706 is coupled to the body 714 of the lever 702 to bias the lever 702 into a locked position. In the example embodiment, the lever 702 is in a locked position when the lever 702 is substantially horizontal relative the extension assembly 606. When the receiver bracket 701 is engaged by the lever 702, an opposing upward force compresses the spring 706 until the lever 702 is disengaged from the first rail member 622, allowing the base assembly 116 to compress. When the first end 710 of the lever 702 is secured to the receiver bracket 701, the locking mechanism 700 and the receiver bracket 701 prevents the shuffler system 100 from being removed from the gaming table 300 while the base assembly 116 is in a compressed position or state. When the base assembly 116 is retracted from the table 300 to a fully extended position or state, the compression spring 706 forces the lever 702 to reengage the first rail member 622 and lock the base assembly 116 in a fully extended state; and the first end 710 of the lever 702 is released from the receiver bracket 701. In some embodiments, the locking mechanism 700 does not include the spring 706, but rather returns to the locked position via another suitable mechanism.

The sleeve bearing 708 is a cylindrical component coupled to the lever 702 such that the sleeve bearing 708 can rotate. When the lever 702 is in the locked position and the extension assembly 606 is in an extended position, the sleeve bearing 708 is positioned within the path of the first rail member 622 of the extension assembly 606 to prevent the extension assembly 606 from compressing. However, when the lever 702 is in an unlocked position (i.e., the lever is engaged by the receiver bracket 701), the second end 712 is lowered relative to its position when the lever 702 is in the locked position. Lowering the second end 712 also lowers the sleeve bearing 708 out of the path of the first rail member 622, and the first rail member 622 may move forward towards the second rail member 624 with the assistance of the rolling sleeve bearing 708. In other embodiments, other suitable components may be used in place of the sleeve bearing 708. For example, an arm extending from the second end 712 may selectively block the first rail member 622 from moving to a compressed position.

With respect again to FIG. 6, in the example embodiment, the base assembly 116 further includes a brake 630 coupled to the first base plate 608 of the first base member 602. The brake 630 is configured to selectively prevent movement of the transport device 104, particularly when the transport device 104 is supporting the shuffler 102 at an installation point. As a result, the transport device 104 can transition between transportation and supporting functionality without compromising either functionality. In the example embodiment, the brake 630 is a rotatable member that, when engaging a ground surface, limits or otherwise prevents the wheels 120 from moving along the ground surface and/or the extension assembly 606 from moving to an extended position from the compressed position until the brake 630 is disengaged (i.e., by rotating the brake away from the ground surface). The wheels 120 may also include wheel brakes 632 to selectively prevent movement of the transport device 104. In other embodiments, additional and/or alternative brakes may be used, including external brakes applied to the transport device 104 (e.g., a block or board positioned behind the wheels 120 to prevent movement away from the installation point). In one example, the extension assembly 606 may be coupled to a brake that is selectively engaged in response to the extension assembly 606 compressing to a predetermined position (e.g., a position that indicates the shuffler 102 is vertically aligned with the installation point) and selectively disengaged during removal of the shuffler 102 from the installation point.

FIG. 8 is a flow diagram of an example installation method 800 that may be used with the shuffler system 100 shown in FIG. 1 to install the automatic card shuffler 102 at the gaming table 300 shown in FIG. 3. In other embodiments, the installation method 800 may include additional, fewer, or alternative steps, including those described elsewhere herein. The method 800 is described herein with respect to FIGS. 1-8.

To begin the method 800, the automatic card shuffler 102 is coupled 802 to the transport device 104 via the mount plate 502 (shown in FIG. 5). In some embodiments, the shuffler 102 may remain coupled to the transport device 104 during use and/or storage such that the coupling step 802 may occur a limited number of times, such as after maintenance of the shuffler 102 or during manufacture of the system 100. In other embodiments, the transport device 104 may be removed from the shuffler 102 after transportation of the shuffler 102 complete, and therefore the coupling step 802 may be performed prior to each time the shuffler 102 is transported.

The shuffler 102 is then moved 804 towards an installation point (i.e., the mounting point 304) via the transport device 104. In at least some embodiments, the restraint device 518 of the adjustment assembly 504 may be engaged during movement 804 to limit or otherwise prevent vertical movement of the shuffler 102, which may be cumbersome. The extension assembly 606 may also be in an extended position during movement of the shuffler 102 and the transport device 104 prior to installation. Moving 804 the shuffler 102 towards the installation point may include aligning the shuffler 102 with the installation along a substantially horizontal axis such that the transport device 104 moves along the horizontal axis to approach the installation point.

As the shuffler 102 approaches the mounting point 304 of the table, the adjustment assembly 504 is unlocked and the height of the shuffler 102 is adjusted 806 to a first height. The first height is greater than a height of the installation surface 306 onto which the shuffler 102 is to be installed. In other embodiments, the first height may actually be lower than the height of the installation surface 306 if the shuffler is to be affixed from below. In at least some embodiments, the restraint device 518 may be engaged again in response to adjusting the shuffler 102 to the first height until the shuffler 102 is ready to be installed at the mounting point 304.

The shuffler 102 is then moved further towards the mounting point 304. In the example embodiment, the extension assembly 606 is engaged to compress 808 from an extended position to a compressed position, thereby compressing the base assembly 116 and moving the shuffler 102 substantially horizontal towards the mounting point 304. The shuffler 102 is then vertically aligned 810 with the installation point (via compressing the extension assembly 606 and/or moving the transport device 104 as a whole), and the height of the shuffler 102 is adjusted 812, via the adjustment assembly 504, from the first height to a second height matching the height of the installation surface 306. In some embodiments, the shuffler 102 and/or the gaming table 300 may include one or more features to secure 814 the shuffler 102 to the mounting point 304. In the example embodiment, the restraint device 518, the brake 630, and/or the wheel brakes 632 may be engaged to prevent the shuffler 102 and transport device 104 from moving. At this point, the shuffler 102 is installed at the gaming table, and play of a card-based game using the shuffler 102 may be initiated 816.

In certain embodiments, to complete installation of the shuffler 102, the transport device 104 may be removed from the shuffler 102 and replaced with another support system. In such embodiments, after the shuffler 102 is supported by the mounting point 304, the mount plate 502 may be removed from the shuffler 102, and the transport device is moved away from the shuffler 102 to couple the support system to the shuffler 102. In at least one embodiment, no additional support system is needed for the shuffler 102, and the shuffler 102 remains supported by the gaming table 300. In other embodiments, the transport device 104 remains coupled to the shuffler 102 after the installation is complete, thereby facilitating a simplified removal process of the shuffler 102 from the table 300.

To remove the shuffler 102 from the gaming table 300 (e.g., for maintenance of the shuffler 102), reversal of the steps in the installation method 800 may be performed. That is, the shuffler 102 is raised away from the installation surface 306, any locks or brakes are disengaged, the extension assembly 606 is moved from the compressed position to an extended position, and/or the transport device is moved away from the table 300.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. A card shuffler system comprising:

an automatic card shuffler configured to shuffle playing cards; and a shuffler transport device coupled to the automatic card shuffler to move and support the automatic card shuffler, the shuffler transport device comprising:

a base assembly configured to move along a ground surface and selectively adjust between an extended position and a compressed position, wherein the base assembly includes a locking mechanism configured to selectively lock the base assembly in the extended position, the base assembly configured to transition to the compressed position from the extended position in response to the locking mechanism engaging a bracket external from the shuffler transport device;

a vertical support extending from the base assembly and coupled to the automatic card shuffler to cantilever the automatic card shuffler over the base assembly; and an adjustment assembly coupled to the vertical support, the adjustment assembly configured to adjust the height of the automatic card shuffler between at least a first height and a second height along a vertical axis.

2. The card shuffler system of claim 1, wherein the shuffler transport device includes a mount plate coupled to the automatic card shuffler and the adjustment assembly.

3. The card shuffler system of claim 1, wherein the adjustment assembly includes a gas spring coupled to the automatic card shuffler to adjust the height of the automatic card shuffler.

4. The card shuffler system of claim 1, wherein the adjustment assembly includes a cartridge coupled to the automatic card shuffler and slidably coupled to the vertical support, the cartridge configured to move between a first position to move the automatic card shuffler to the first height and a second position to move the automatic card shuffler to the second height.

5. The card shuffler system of claim 1, wherein the base assembly includes a first base member, a second base member, and an extension assembly coupled between the first base member and the second base member, the extension assembly configured to selectively extend and compress the base assembly.

6. The card shuffler system of claim 1, wherein the adjustment assembly includes a restraint device configured to selectively prevent the adjustment assembly from adjusting the height of the automatic card shuffler.

7. An automatic card shuffler for shuffling playing cards, the automatic card shuffler comprising:

a housing; and a shuffler transport device coupled to the housing to move and support the automatic card shuffler, the shuffler transport device comprising:

a base assembly configured to move along a ground surface and selectively adjust between an extended position and a compressed position, wherein the base assembly includes a locking mechanism configured to selectively lock the base assembly in the extended position, the base assembly configured to transition to the compressed position from the extended position in response to the locking mechanism engaging a bracket external from the shuffler transport device;

a vertical support extending from the base assembly and coupled to the housing to cantilever the automatic card shuffler over the base assembly; and an adjustment assembly coupled to the vertical support, the adjustment assembly configured to adjust the height of the automatic card shuffler between at least a first height and a second height along a vertical axis.

8. The automatic card shuffler of claim 7, wherein the adjustment assembly includes a gas spring coupled to the housing to adjust the height of the automatic card shuffler.

9. The automatic card shuffler of claim 7, wherein the base assembly includes a first base member, a second base member, and an extension assembly coupled between the first base member and the second base member, the extension assembly configured to selectively extend and compress the base assembly.

10. The automatic card shuffler of claim 9, wherein the base assembly includes a brake to selectively lock the base assembly in a compressed position.

11. The automatic card shuffler of claim 7, wherein the adjustment assembly includes a restraint device configured to selectively prevent the adjustment assembly from adjusting the height of the automatic card shuffler.

* * * * *